United States Patent [19]

Sato et al.

[11] 4,423,356

[45] Dec. 27, 1983

[54] SELF-SHIFT TYPE GAS DISCHARGE PANEL

[75] Inventors: Sei Sato, Akashi; Masayuki Wakitani, Hyogo; Kenichi Oki, Takarazuka; Shoshin Miura, Kobe; Hisashi Yamaguchi, Hyogo; Yoshinori Miyashita, Himeji; Tsutae Shinoda, Akashi; Kazuo Yoshikawa, Kobe; Kurahashi Keizo, Kobe; Toyoshi Kawada, Kobe, all of Japan

[73] Assignee: Fujitsu Limited, Kawasaki, Japan

[21] Appl. No.: 383,143

[22] Filed: May 28, 1982

[30] Foreign Application Priority Data

Jun. 23, 1981 [JP] Japan ..... 56-97745

[51] Int. Cl.[3] ..... H01J 65/00; H05B 41/00

[52] U.S. Cl. ..... 315/169.2; 313/582

[58] Field of Search ..... 315/169.2, 169.4; 340/768; 313/582, 586, 587

[56] References Cited

U.S. PATENT DOCUMENTS 3,781,600 12/1973 Coleman et al. ..... 313/582 X 4,132,924 1/1979 Yamaguchi et al. ..... 315/169.2 X

*Primary Examiner*—Eugene R. LaRoche

*Attorney, Agent, or Firm*—Staas & Halsey

[57] ABSTRACT

An AC memory driving type self-shift type gas discharge panel prevents accidental abnormal discharges caused by deviated abnormal charges. Abnormal charges are significantly accumulated at both ends of a shift channel consisting of a regular arrangement of a write discharge cell and shift discharge cells. Therefore, conductive layers are provided adjacent to at least both ends of the shift channel in order to dissipate the abormal charges.

15 Claims, 13 Drawing Figures

SELF-SHIFT TYPE GAS DISCHARGE PANEL

BACKGROUND OF THE INVENTION

This invention relates to an improved AC memory driving type self-shift type gas discharge panel. It more specifically relates to a new type panel structure which can suppress accidental abnormal discharges caused by deviated abnormal charges.

The self-shift type gas discharge panel is classified as an AC memory driving type plasma display and provides means to directly shift the information written in the form of a pattern of discharge spots at one end of the panel, with the pattern being unchanged during the shift in order to obtain a stationary display at a predetermined position. The electrodes of such a panel are covered with a dielectric layer in order to attain the memory function. Presently, the panel with such a structure has the problem of undesirable generation of abnormal discharges during operation, which causes a disturbance in the displayed information in the panel, and breakdown of the dielectric layer.

The abnormal discharge appears, for instance, around the discharge spot group corresponding to the displayed information in the form of unit discharge spots, or it appears as a comparatively large light emitting pattern after a momentary emission of light resembling a spark.

Such an undesirable abnormal discharge is particularly significant when the so-called wall charge transfer system is employed as the drive method, in which a combination of wall charges is used for the shift operation as described in U.S. Pat. No. 3,781,600 by Coleman et al. It is also significant when the drive method of the so-called space charge coupling system is employed, in which the coupling of space charge is used for the shift operation as described in U.S. Pat. No. 4,132,924 by Yamaguchi et al. Therefore, the cause is considered to be that abnormal charges are accumulated in a polarized condition at the surface of the dielectric layer corresponding to the electrodes at both ends of a shift channel due to the repeated shift operation. FIG. 1 shows schematically the deviation of such abnormal charges. In this figure, the horizontal axis indicates the shift channel with the right side being the end for writing in information, while the vertical axis shows the resulting voltage. Such a deviated wall charge becomes significant due to the repeated shift operation, and when it exceeds a certain value an abnormal field based on this abnormal wall charge induces an avalanche phenomenon in the vicinity of the abnormal wall charge, often in combination with an external field such as the shift voltages, and thereby an abnormal discharge occurs which is not based on the data, as explained above.

It is known to provide electrodes for dissipating the abnormally accumulated charge at both ends of the shift channel in order to avoid such abnormal discharges. For example, the gas discharge panel of the type of the above-cited U.S. Pat. No. 3,781,600 employs a structure in which the accumulation of charges is prevented by directly exposing electrodes at both ends of the shift channel in the gas discharge space. However, use of exposed electrodes as explained above causes the electrode material to sputter due to ion impacts during discharge, or causes oxidation of the electrodes during the baking process for the sealing material when sealing the panel. At any rate, employment of such exposed electrodes has the disadvantage that the operating lift is curtailed due to a change of the discharge characteristics at the area near the pertinent electrodes. In addition, it is also a problem that the upper limit of the write voltage margin is lowered. Namely, when the write voltage is applied to the exposed write electrodes, a heavy current flows for a comparatively long period, and therefore an intensive discharge continues for this long period at the write discharge cells defined by the write electrodes, which causes an unwanted discharge at the adjacent shift discharge cells. Consequently, it is necessary to keep the upper limit of said write voltage to a lower value.

On the other hand, U.S. patent application Ser. No. 213,464, entitled "Self-Shift Type Gas Discharge Panel" by Shinoda et al, assigned to the same assignee as the assignee of the present invention, proposes a structure in which a pinhole or crevice is provided for dissipating the charges on the dielectric layer in the vicinity of the electrodes at both ends of the shift channel. However, such a charge dissipation structure brings about problems, for instance, it is difficult to form this panel having homogeneous characteristics with excellent reproduceability, and also in this case, the electrodes are oxidized due to the existence of the pinhole or crevice.

SUMMARY OF THE INVENTION

This invention offers a new type of self-shift gas discharge panel which eliminates problems of the above-mentioned conventional drive methods and panel structures. More specifically, it offers a practical panel structure for avoiding accumulation of abnormal charges at least at both ends of the shift channel, in order attain the main object of the present invention.

Briefly explained, the present invention is characterized in that a conductive layer is provided at least adjacent to the discharge cells at both ends of each shift channel, and the charges are dissipated by leaking through this conductive layer.

Other objects and characteristics of the present invention are apparent from the explanation of the preferred embodiments with reference to the drawings.

DETAILED DESCRIPTION OF THE PREFERRED EMBODIMENTS

Figure 2A:
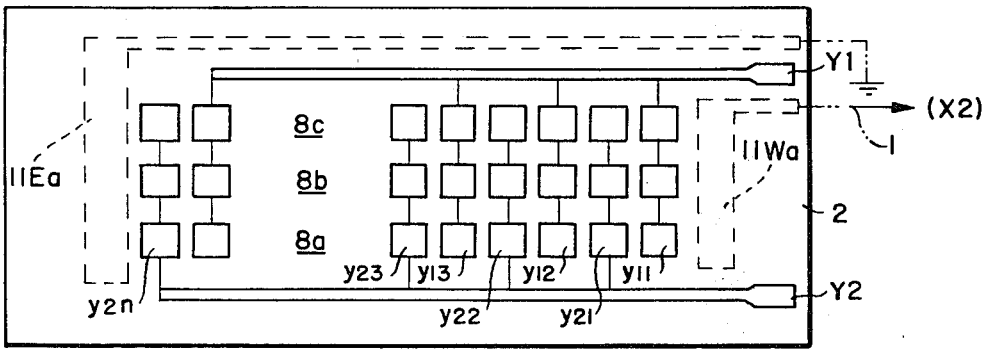
FIGS. 2A–C show a sectional view and disassembled plan views of a principal portion of the self-shift gas discharge panel having a parallel electrode conductor structure adopting the present invention.
Figure 2B:
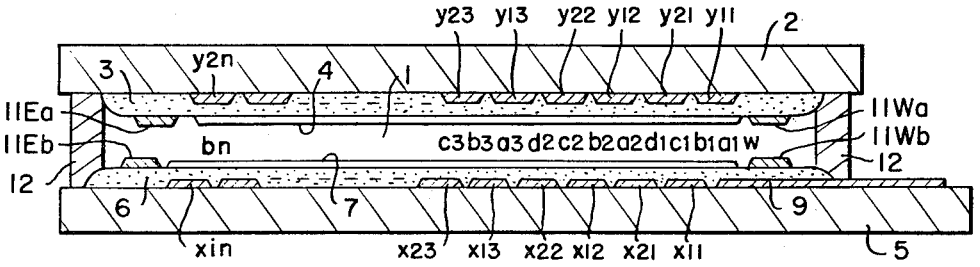
Figure 2C:
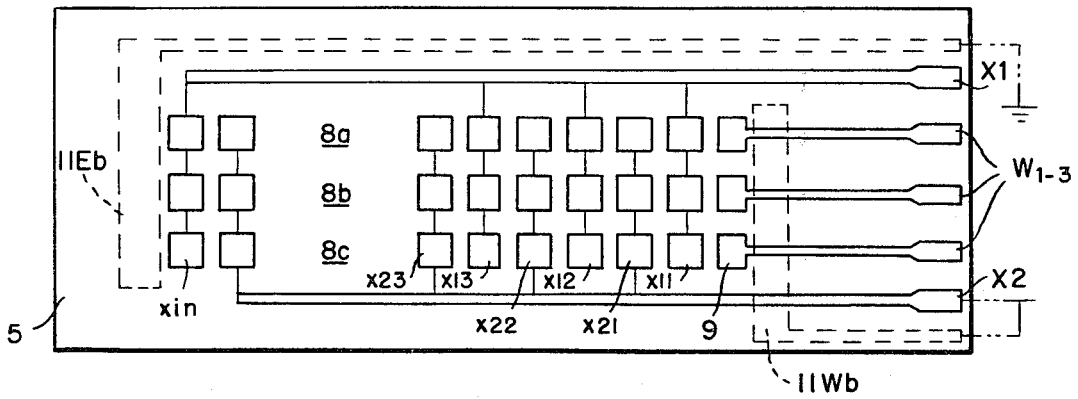

FIGS. 2A–C show a sectional view and disassembled plan views of a principal portion of the self-shift type gas discharge panel according to an embodiment of the present invention. In this case, the shift electrode arrangement itself is the same as that shown in FIG. 7 of the U.S. Pat. No. 4,190,788 by Yoshikawa et al. Namely, two groups of Y shift electrodes $y_{1i}$ and $y_{2i}$ (where i is a positive integer) alternately connected to the two phases of the buses $Y_1$, $Y_2$ via the parallel lead conductors (refer to FIG. 2A) are provided on the inside of the glass substrate 2 arranged in opposition across the gas discharge space 1, and these electrodes are covered with a dielectric layer 3 and a surface layer 4 of MgO. On the inside surface of the other glass substrate 5, the X shift electrode $x_{1j}$ and $x_{2j}$ (where j is a positive integer) alternately connected to the other two phases of the buses $X_1$, $X_2$ via the parallel lead conductors (refer to FIG. 2C) are provided and covered with the dielectric layer 6 and the surface layer 7 of MgO in the same way. These X shift electrodes and Y shift electrodes are mutually opposed so as to form the illustrated offset portions with an offset of a half pitch, defining between the opposing portions the shift discharge cells a1, b1, c1, d1, a2, . . . in such a manner that each electrode is sequentially used in common for two adjacent cells. Such a regular arrangement of shift discharge cells forms in this case the three shift channels 8*a*, 8*b* and 8*c*, and the write electrodes 9 connected to the terminals $W_1$ to $W_3$ are respectively provided at the right end of said shift channels, forming the write discharge cells w between the first shift electrode $y_{11}$ of each shift channel.

Such a structure for the shift channels is almost the same as the panel structure described in the above-cited U.S. Pat. No. 4,190,788. However, the present invention is materially different from this prior art in that the two pairs of charge leak conductors 11Wa, 11Wb and 11Ea, 11Eb are provided as indicated on the dielectric layers 3, 6 adjacent to the discharge cells at both ends of the shift channels including said write discharge cells w, namely adjacent to the position of the write discharge cell w and the terminating shift discharge cell dn. It is desirable to form these conductor layers 11Wa, 11Wb, 11Ea, 11Eb with a material which is comparatively stable even after the thermal process for forming the panel, so that the process does not contaminate the surface layer determining the basic characteristics of the discharge. For example, indium oxide ($In_2O_3$), tin oxide ($SnO_2$) or a mixture of these (ITO) are preferred. Hereinafter, this conductor layer of the present invention is called the charge leak layer. These charge leak layers 11Wa, 11Wb, 11Ea, 11Eb are lead out to the end of the panel as illustrated to be connected to the external drive circuit, to be clamped to a predetermined voltage, etc. In practice, these may be connected to a DC power supply, or, as in this embodiment, 11Wa and 11Wb may be connected to the bus X2, while 11Ea and 11Eb are connected to ground potential. In short, these charge leak layers cause charges to move in order to reestablish the proper potential, whenever these abnormal charges tend to accumulate on the surface to influence the operation and cause abnormal discharges and voltages.

Figure 1:
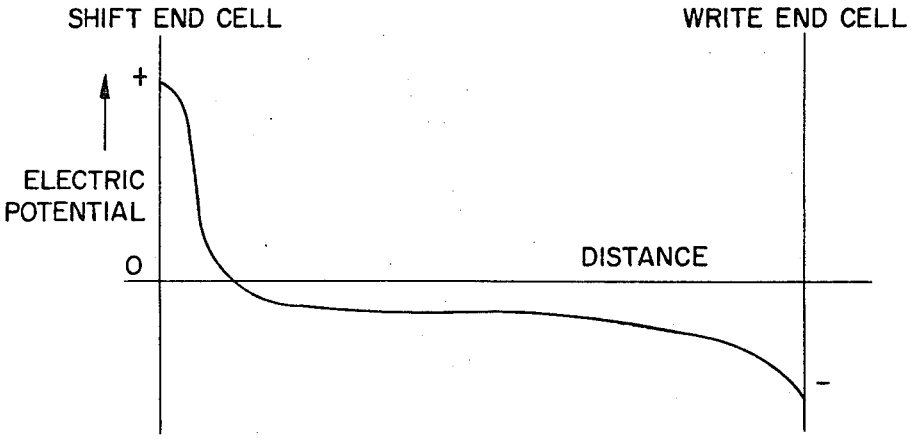
FIG. 1 shows the charge distribution for explaining the undesired generation of abnormal charge in the AC memory driving type self-shift gas discharge panel.
Figure 3:
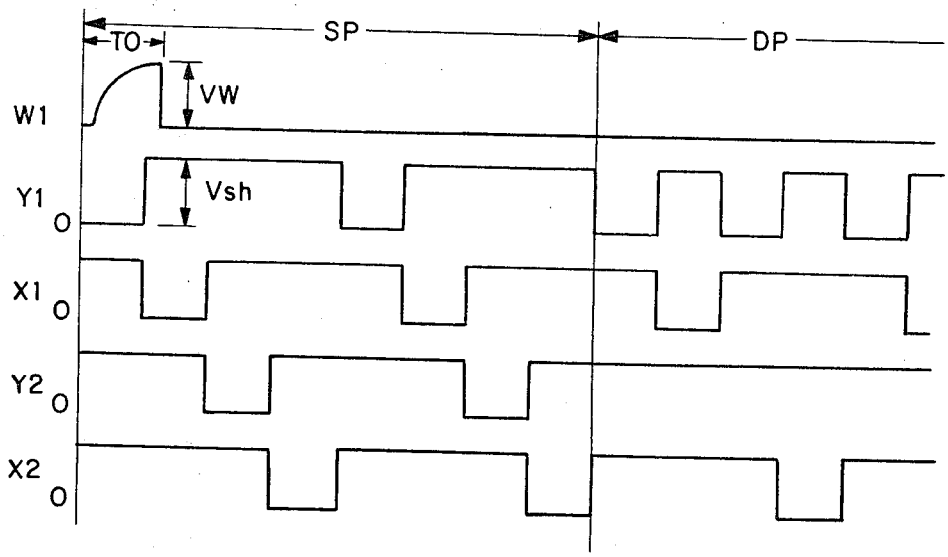
FIG. 3 shows the drive voltage waveforms for explaining the operation of the panel shown in FIG. 2.

Thus, as explained above, when the charge leak layers 11Wa, 11Wb, 11Ea and 11Eb are provided on the dielectric layers 3, 6 adjacent to the cells at both ends of the shift channel, the wall charges which are unwanted for the normal shift discharge operation but which tend to accumulate near or on the dielectric layers are quickly dissipated by this charge leak layer. Thus, abnormal charges which cause undesired discharges are not accumulated. The charge leak layers 11W, 11E may be formed only on one single electrode substrate. Such a structure will be explained in more detail from the point of view of the wall charge transfer type driving method explained previously. FIG. 3 shows the drive voltage waveforms which are applied and to the shift buses $Y_1$ to $X_2$ and, for instance, to the write electrode terminal $W_1$. In this figure, SP is the write and shift period and DP is the display period. As is apparent from the drive voltage waveforms of FIG. 3, a positive write voltage $V_W$ is applied to the write electrode 9 during the period T0 and a write discharge occurs. Therefore, negative wall charges are formed on the dielectric surface layer 7 at a position corresponding to the pertinent write electrode and thereby positive wall charges are formed on the dielectric layer surface 4 at a position corresponding to the opposite shift electrode $y_{11}$. The successive shift operation is performed in such a manner that the positive wall charges are transferred by sequentially dropping the voltage of successive shift electrodes to the ground potential from the shift voltage $V_{sh}$, and therefore the negative charges remain on the write cell surface after the shift operation. While such write and shift operations are repeated, the wall charges are neutralized by the polarity inversion of each shift operation at each intermediate shift discharge cell of each shift channel. As a result, accumulation of residual charge, for the wall charge transfer type driving method now being discussed, is comparatively less than as shown in FIG. 1, but the portion corresponding to the write electrode allows accumulation of negative charges, while the other edge allows accumulation of the transferred positive charges. In case the charge leak layers 11Wa, 11Wb, 11Ea, 11Eb are provided on the dielectric layer in the vicinity of the write cell w and the final shift cell dn of each shift channel, the negative charges occurring with the shifting discharge accumulate essentially entirely on the charge leak layers 11Wa, 11Wb which are exposed to the gas space, and thereafter are dissipated to said bus $X_2$. Meanwhile, the positive charges are essentially entirely accumulated on the charge leak layers 11Ea, 11Eb and then dissipated to ground. As a result, abnormal charges which may cause undesired discharges are not accumulated on the dielectric surface layers at the ends of the shift channels. In this embodiment, the shift voltage is applied to the charge leak layers 11Wa, 11Wb on the write side, and this voltage does not cause any discharge at the area opposing the charge leak layer across the discharge gap.

A method of manufacturing such a panel is now explained. Firstly, an electrode conductor of three layers, of chrome (Cr) in the thickness of 750 angstroms, of copper (Cu) in the thickness of 2 microns, and of chrome (Cr) in the thickness of 750 angstroms is formed by sputtering these materials sequentially on the glass substrate 2, 5. Then the surface Cr layer is selectively removed by etching, leaving, if desired, also a portion extending outside of the area to be sealed after the panel is assembled. As a result, electrode conductors of two layers of Cr/Cu can be formed. Here, the shift electrodes $y_{1i}$, $y_{2i}$, $x_{1i}$, $x_{2i}$ and write electrodes 9 as shown in FIG. 2 are formed by executing the patterning/etching based on the desired electrode pattern. Thereafter, the dielectric layers 3, 6 or $Al_2O_3$ in the thickness of 5 to 10 microns are formed on the electrode forming substrate by a vacuum evaporation method. The panel manufacturing process up to this procedure is presently known and the above explanation is based on the thin film forming technology. But a structure obtained by the presently known thick film technology may also be used, for example, a combination of forming the electrodes with an Au paste and of forming the dielectric layer with a low melting point glass.

Next, an evaporation masks having apertures matching the shape of said charge leak layers 11Wa, 11Wb, 11Ea, 11Eb is disposed on said dielectric layers 3, 6, and $In_2O_3$ in the thickness of 2000 to 10,000 angstroms is coated by an evaporation method.

Thereby, the charge leak layers 11Wa, 11Wb, 11Ea, and 11Eb as shown in FIG. 2 are formed on the dielectric layers. It is also possible as another method that the $In_2O_3$ is coated on the entire part of the dielectric layers 3, 6, then a resist is coated, exposed and developed to form a patterning film, and the dielectric layer is then etched with an HC solution. Thus, the charge leak layer having a specified shape can be obtained.

Thereafter, a low melting point glass for sealing the panel is screen-printed around the glass substrate and the substrates are temporarily baked at a temperature of about 420° C. Thereby the sealing portion 12 can be formed. Also, the MgO is coated by an evaporation method without covering the charge leak layers 11Wa, 11Wb, 11Ea and 11Eb using the desired evaporation masks. Thus, the surface layers 4, 7 in the thickness of about 5000 angstroms can be formed only on the portions of the dielectric layers corresponding to the electrodes.

A pair of glass substrates 2 and 5 thus formed are arranged opposite each other by a spacer (not illustrated) so that a gap (discharge space) of about 90 to 110 microns is obtained between them. Then the sealing material is baked and said discharge space is filled with a discharge gas, thus completing the abovementioned self-shift type gas discharge panel. The $In_2O_3$ layers which become the charge leak layers 11Wa, 11Wb, 11Ea, 11Eb does not contaminate the MgO surface layers 4, 7 due to any thermal influence even if the sealing material is baked. Therefore, these surface layers of the present invention assure a desired low voltage drive and a stabilized discharge characteristic.

The subject matter of this invention is not limited to the embodiments described above, but rather diverse modifications and extensions are clearly understood from the present disclosure. Some of these other applications are not discussed.

Figure 4A:
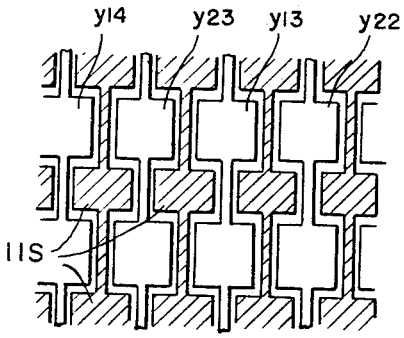
FIGS. 4A–B and 5A–B schematically show plan views of principal portions of various modifications of the panel in accordance with the present invention.
Figure 4B:
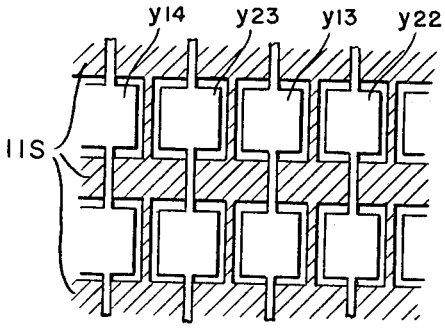

(1) The charge leak layers may be provided on the dielectric layers, expect not over the electrodes defining each cell for the shift channels, as indicated by the hatched portions 11S in the plan views of FIGS. 4A–B showing typical Y electrodes. Such structures make it possible to dissipate unwanted extra charges around the center of the channel and assures more stable discharge characteristics.

Figure 5A:
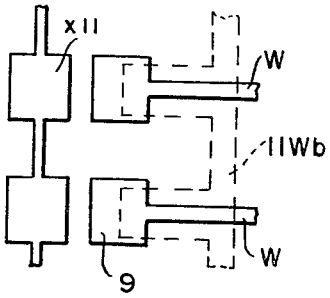
Figure 5B:
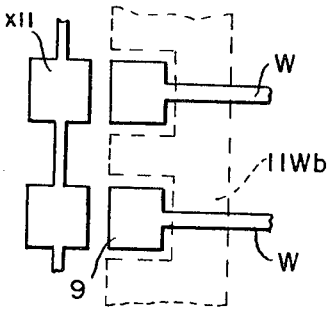

(2) The charge leak layer 11Wb can have the patterns indicated by the dotted lines portions at the writing in sides of the shift channels in FIGS. 5A–B. The noble metals such as Au, Pt can also be used as the material for those charge leak layers. Particularly, according to a charge leak layer of aluminum, since the surface resistance coefficient is about 0.1 ohm/-square which is very small as compared with that of the snO2 and $In_2O_3$ mentioned above, the charge leak layer can be clamped almost to the same potential along its entire length, from the end for contacting the voltage clamp to the opposite end. Therefore, this structure is very effective for giving a uniform charge dissipation effect to all of the discharge cells of a shift channel, or to a plurality of shift channels arranged in parallel if adopted into a multi-row display panel having many shift channels.

Figure 6A:
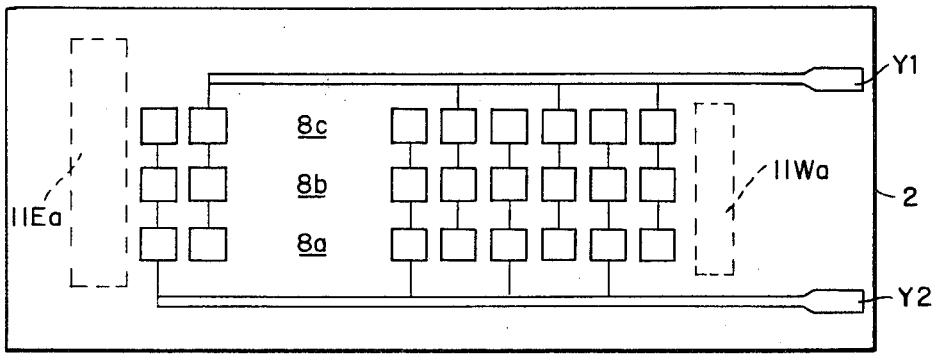
FIGS. 6A to 6C show a sectional view and disassembled plan views of a principal portion of another embodiment of a panel of the present invention.
Figure 6B:
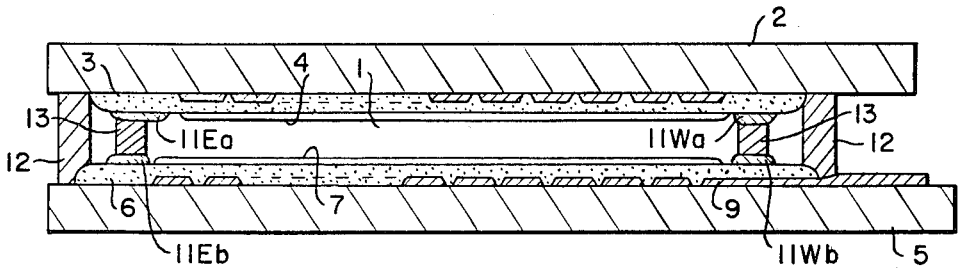
Figure 6C:
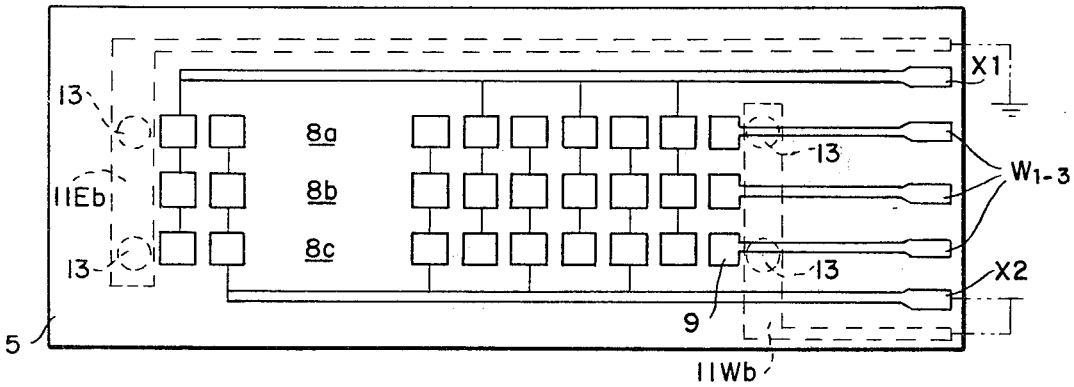

(3) In the above embodiment, the lead-out wires for connecting the charge leak layers to the voltage sources are formed on both glass substrates in order to supply the charge leak layers 11Wa, 11Wb, 11Ea, 11Eb provided at both ends of the shift channel with the predetermined potentials, but those lead-out wires may be provided on a single glass substrate 5 as shown in FIGS. 6A–C, thus reducing the total number of such lead-out wires. FIGS. 6A–C are the same as FIGS. 2A–C, except for the charge leak layer lead-out structure. Therefore, only the lead-out structure is explained in detail. Namely, as shown in FIGS. 6A–C, a conductive material 13 for short-circuiting across the discharge gap is provided between the charge leak layers 11Ea and 11Eb, and between 11Wa and 11Wb, in order to short-circuiting the opposing pairs of charge leak layers. This conductive material 13 for short-circuiting is, for example, composed of a cylindrical conductive material such as nickel, aluminum or stainless steel and may be provided also to serve as spacers between the charge leak layers 11Ea and 11Eb, 11Wa and 11Wb when assembling the panel using the sealing material 12. In case the pairs of charge leak layers 11Ea, 11Eb and 11Wa, 11Wb are respectively short-circuited by said short-circuiting material 13, as in the case of the aforementioned embodiment, the lead-out wires provided at the edge of the glass substrate 2 to maintain each of the charge leak layers 11Ea and 11Wa to the predetermined potentials are no longer necessary. As a result, only the lead-out wires connected to the conductors 11Eb, 11Wb for charge dissipation are required to connect each pair of the charge leak layers 11Wa, 11Wb and 11Ea, 11Eb, to the respective predetermined voltage sources, for instance, as in the case of FIGS. 2A–C, via the lead-out wires provided at the edge of the glass substrate 5.

Figure 7:
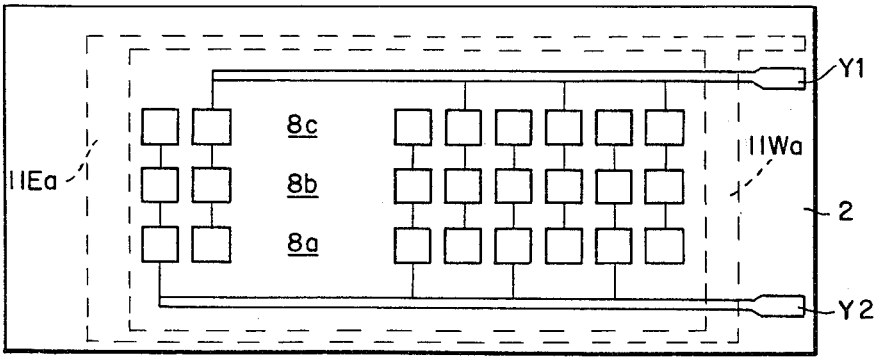
FIG. 7 schematically shows a plan view of a principal portion of another embodiment of a panel of the present invention.

(4) In the above two embodiments, said charge leak layers 11Wa, 11Wb, 11Ea and 11Eb may be connected respectively to any of the predetermined voltage sources, but as shown in FIG. 7, which shows a typical Y electrode substrate, connection to such a voltage source is not always necessary in case these charge leak layers are configured so that they are coupled to each other on the same substrate.

(5) The charge leak layers may be formed directly on the glass substrate. Namely, the charge leak layers 11Wa, 11Wb, 11Ea, 11Eb are not necessarily formed at the same position of the dielectric layer for covering the shift electrodes. As a result, such a charge leak layer can be directly provided on the glass substrate.

(6) A pane of the present invention, as applied above to the self-shift type gas discharge panel having a parallel electrode lead conductor structure, can also be applied to a panel having the meander electrode structure as discussed in the above-mentioned U.S. Pat. No. 4,132,924, a panel having an electrode structure in which the number of electrode groups is larger than the 2 groups × 2 groups as discussed above, a panel providing a parallel electrode structure, a panel having a matrix electrode structure or a monolithic structure, etc.

As is apparent from the above explanation, in short, the present invention discloses an AC memory driving type self-shift type gas discharge panel wherein a charge leak conductive layer which prevents the accumulation of abnormal wall charges is provided in the vicinity of the discharge cells at least at both ends of the shift channels, and thereby accidental discharge caused by the deviated abnormal charges which are peculiar to the self-shift type panel can be prevented. In addition, since the electrodes at both ends of said shift channels are protected by the dielectric layers, they are not sputtered during discharge and not oxidized while the gas space is sealed. Moreover, the materials selected for the charge leak layer is stable, even after the thermal process for forming the panel, and does not contaminate the dielectric surface layer. Therefore, stable characteristics and a long operating life can be assured. This invention is very effective for improving the performance of an AC memory driving type self-shift type gas discharge panel. The present invention is limited only by the scope of claims below.

We claim:

1. A self-shift type gas discharge panel comprising:

at least one shift channel comprising a regular arrangement of a plurality of shift discharge cells defined between opposing portions of shift electrodes on a pair of substrates separated by a gas discharge space, the shift electrodes being covered with a dielectric layer for charge accumulation and sequentially and regularly connected by respective shift electrode connections to a plurality of buses for providing shift voltages, a corresponding write discharge cell defined between a portion of one of said shift electrodes on one of said substrates and a write electrode located on the other one of said substrates, at one end of each said shift channel, each write electrode being connected to a corresponding write voltage terminal and covered with said dielectric layer, and at least one charge leak conductive layer provided on at least one of said substrates adjacent at least to the discharge cells at both ends of each said shift channel, said at least one charge leak conductive layer having a configuration for dissipating abnormal charges caused by the operation of said panel.

2. The panel of claim 1, wherein said at least one charge leak conductive layer is provided on the dielectric layer on at least one respective one of said substrates without being electrically connected to said shift electrodes defining said discharge cells.

3. The panel of claim 1, wherein said at least one charge leak conductive layer comprises at least one material selected from indium oxide and tin oxide.

4. The panel of claim 1, wherein said at least one charge leak conductive layer comprises aluminum.

5. The panel of claim 1, comprising at least one of said charge leak conductive layers provided on each said substrate, wherein said charge leak conductive layers are provided at least at both ends of each said shift channel with opposing portions across said discharge space on the two insulating substrates.

6. The panel of claim 1, wherein the charge leak conductive layers are clamped to respective predetermined voltage sources.

7. The panel of claim 1, wherein each charge leak conductive layer at one end of each shift channel on one of said substrates is electrically coupled to another charge leak conductive layer at the same end on the other substrate.

8. The panel of claim 5, comprising two pairs of the charge leak conductive layers, each pair being arranged in opposing positions on said substrates across said discharge space and clamped to a respective predetermined voltage source.

9. The panel of claim 6, comprising at least two of said charge leak conductive layers, one located at the write end of each shift channel and connected electrically in common with a selected bus of said shift electrodes for supplying the respective shift voltage thereto, and the other charge leak conductive layer located at the other end of the shift channel and connected to a reference voltage source.

10. The panel of claim 8, wherein a conductive material is inserted between the opposing portions of each said pair of said charge leak conductive layers in order to short-circuit them.

11. The panel of claim 10, said conductive material being nickel, aluminum or stainless steel.

12. The panel of claim 1, comprising one of said charge leak conducting layers at each end of each said shift channel at least on one of said substrates, and these charge leak conductive layers being electrically connected together.

13. The panel of claim 1, comprising a plurality of said shift channels and respective ones of said charge conductive layers extending along both sides of each said shift channel.

14. The panel of claim 13, said electrodes being wider than said shift electrode connections, said charge leak conducting layers extending across said shift electrode connections.

15. The panel of claim 1, comprising said at least one charge leak conductor layer having a portion that is located on the one of said substrates on which each said write electrode is formed, and covering at most a portion of each said write electrode.

* * * * *

UNITED STATES PATENT AND TRADEMARK OFFICE

CERTIFICATE OF CORRECTION

PATENT NO. : 4,423,356

DATED : 27 December 1983

INVENTOR(S) : Sato et al

It is certified that error appears in the above-identified patent and that said Letters Patent is hereby corrected as shown below:

Col. 1, line 68, "lift" should be --life--.

Col. 2, line 31, after "order" insert --to--.

Col. 5, line 4, change "masks" to --mask--;
line 33, "abovementioned" should be --above-mentioned--.

Col. 6, line 20, "short-circuiting" should be --short-circuit--;

line 59, "pane" should be --panel--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*